US012569051B2

(12) United States Patent
Valiulis et al.

(10) Patent No.: US 12,569,051 B2
(45) Date of Patent: Mar. 10, 2026

(54) PORTABLE SMALL-ITEM STORAGE APPARATUS

(71) Applicants: Stanley Valiulis, Rockford, IL (US); Lindsey Fleischhauer, Naperville, IL (US)

(72) Inventors: Stanley Valiulis, Rockford, IL (US); Lindsey Fleischhauer, Naperville, IL (US)

( * ) Notice: Subject to any disclaimer, the term of this patent is extended or adjusted under 35 U.S.C. 154(b) by 641 days.

(21) Appl. No.: 18/054,483

(22) Filed: Nov. 10, 2022

(65) Prior Publication Data

US 2023/0146849 A1 May 11, 2023

Related U.S. Application Data

(63) Continuation-in-part of application No. 29/866,029, filed on Aug. 25, 2022.

(60) Provisional application No. 63/277,713, filed on Nov. 10, 2021.

(51) Int. Cl.
*A45F 5/00* (2006.01)
*A47K 10/32* (2006.01)

(52) U.S. Cl.
CPC ..... *A45F 5/00* (2013.01); *A47K 10/32* (2013.01); *A45F 2005/008* (2013.01); *A47K 2010/3266* (2013.01)

(58) Field of Classification Search
CPC ..... A45F 5/00; A44C 23/00
USPC ..... 224/219, 218
See application file for complete search history.

(56) References Cited

U.S. PATENT DOCUMENTS 2,449,324 A 9/1948 Robinson
4,536,889 A 8/1985 Taylor et al.
4,592,936 A * 6/1986 Ferguson ..... A47G 33/08 428/34.1
4,736,876 A 4/1988 Kriss
(Continued)

FOREIGN PATENT DOCUMENTS

WO 2005094711 A2 10/2005

OTHER PUBLICATIONS

Wristband Pill Holder Bracelet—FDA Food Grade Silicone Dispenser—Veteran Owned Company Nilly Band, retrieved from the internet, retrieved on Nov. 10, 2022; <URL: https://www.desertcart.in/products/59433912-wristband-pill-holder-bracelet-fda-food-grade-silicone-dispenser-veteran-owned-company-nilly-band>.

*Primary Examiner* — Nathan J Newhouse
*Assistant Examiner* — Lester L Vanterpool

(57) ABSTRACT

A portable small-item storage apparatus is an apparatus that enables the user to carry various small items including, but not limited to, wet wipes, band-aids, etc., in a practical and comfortable manner. To do so, the apparatus includes a plurality of spherical containers and a plurality of treasury tags. The plurality of spherical containers includes several spherical containers arranged to store different small items. The plurality of spherical containers can be selectively opened to retrieve the items stored within the corresponding spherical container. The plurality of spherical containers can also be configured to enable the controlled dispensing of the items stored within. The plurality of treasury tags enables the arrangement of the plurality of spherical containers into a circular pattern so that the apparatus can be worn as a bracelet. The plurality of treasury tags also enables the apparatus to expand or contract to comfortably fit on the user's arm.

18 Claims, 14 Drawing Sheets

(56) References Cited

U.S. PATENT DOCUMENTS 5,007,252 A * 4/1991 Mochizuki ..... A44C 5/209 63/3
5,351,506 A * 10/1994 Febrer ..... A44C 5/2028 63/3.1
5,528,909 A * 6/1996 Tonakawa ..... A44C 15/00 63/3
6,056,729 A * 5/2000 Yu ..... A61M 35/10 63/3
6,296,364 B1 * 10/2001 Day ..... A44C 15/0015 362/249.06
7,735,682 B1 * 6/2010 Cassel ..... A47K 10/38 221/24
D672,465 S * 12/2012 Sherman ..... D24/207
9,931,579 B1 * 4/2018 Garcia ..... B65D 25/10
9,968,179 B2 5/2018 Patel et al.
9,994,384 B2 * 6/2018 Glass ..... B65D 5/4204
10,413,025 B1 * 9/2019 Cwalinski ..... A61L 2/18
D871,955 S * 1/2020 Naqvi ..... D11/6
10,750,795 B1 * 8/2020 Lin ..... A44C 11/002
11,647,817 B2 * 5/2023 Hsu ..... G06M 1/27 434/246
D1,005,399 S * 11/2023 Woods ..... D21/398
2009/0031757 A1 * 2/2009 Harding ..... A44C 5/003 63/3
2009/0089988 A1 * 4/2009 Johnson, Sr. ..... A61G 17/0166 27/1
2010/0001016 A1 * 1/2010 Savage ..... B65D 83/0894 221/45
2011/0204049 A1 * 8/2011 Weder ..... B65D 11/02 53/457
2012/0074029 A1 * 3/2012 Lantinen ..... B65D 85/60 206/524.7
2013/0104599 A1 5/2013 Beldiman
2014/0367405 A1 * 12/2014 Gerasimova ..... A45F 5/00 221/45
2016/0213508 A1 * 7/2016 Sherman ..... A44C 15/00
2019/0239588 A1 * 8/2019 Hart ..... A44B 99/00

* cited by examiner

PORTABLE SMALL-ITEM STORAGE APPARATUS

The current application is a continuation-in-part (CIP) application of the U.S. design application Ser. No. 29/866,029 filed on Aug. 25, 2022.

The current application also claims a priority to a U.S. provisional application Ser. No. 63/277,713 filed on Nov. 10, 2021.

FIELD OF THE INVENTION

The present invention relates generally to personal accessories and portable storage containers. More specifically, the present invention provides a wearable accessory designed to carry several small items such as sanitizing wipes in a comfortable and practical manner.

BACKGROUND OF THE INVENTION

Nowadays, the ability to carry wet wipes in a practical and comfortable manner is essential for many people. For example, many parents are often in need of wet wipes to clean their children, sanitize objects or surfaces, etc. Now, there are different products available to help users carry any necessary items, such as wet wipes. For example, storage bracelets that can dispense tissues, wipes, etc., exist in the industry. A user can wear the bracelets on the wrists and the bracelets allow the user to have wet wipes available at any time and on any occasion. By having wet wipes available at any time, the user does not have to waste time to find the wipes but use the wet wipes almost immediately. However, the typical wet wipe dispensing bracelets do not allow the user to choose the type of wet wipes to carry since the wet wipes are pre-determined. Additionally, some of the wipe dispensing bracelets are not refillable or allow for other necessary items to be carried along, such as band-aids. Therefore, there is a need for a better wearable device that allows users to carry various necessary items in a comfortable and practical manner.

An objective of the present invention is to provide a portable small-item storage apparatus that is capable of dispensing wet wipes and other necessary items. The present invention enables the user to carry essential items comfortably and practically in a wearable device that can be worn on the wrist or hanged from another object, such as a handbag. Another objective of the present invention is to provide a portable small-item storage apparatus that enables the user to refill and carry different essential items. The present invention provides several storage units that can be easily refilled so that the user can carry the desired items on the present invention. Another objective of the present invention is to provide a portable small-item storage apparatus that includes different storage units capable of properly storing different items. The several storage units of the present invention are designed to properly hold the different items to be carried, such as wet wipes, band-aids, etc. Additional features and benefits of the present invention are further discussed in the sections below.

SUMMARY OF THE INVENTION

The present invention is a portable small-item storage apparatus designed to carry different essential items in a practical and comfortable manner. The present invention, also referred to as the Boogie Bracelet, includes several storage units arranged into a bracelet-like structure that can be worn or hanged from another object, such as a handbag. Each storage unit of the present invention is designed to carry various essential items, such as wet wipes, band-aids, etc. The storage units are connected to each other by elastic fasteners that enable the present invention to expand and/or contract to fit on the arm of the user. Further, each storage unit can be designed to store specific items. For example, some storage units can include an opening that facilitates the dispensing of wet wipes while conserving the condition of the wet wipes. Other storage units can include a hinged body that can be selectively opened to retrieve the items stored within the storage units. Other storage units can include different designs that accommodate specific items. Furthermore, the present invention can be designed to enable the present invention to be hanged from another object. For example, the present invention can be hanged from a handbag using a keychain, a carabiner, etc. Additional features can be included to accommodate other essential items.

DETAIL DESCRIPTIONS OF THE INVENTION

All illustrations of the drawings are for the purpose of describing selected versions of the present invention and are not intended to limit the scope of the present invention.

Figure 1:
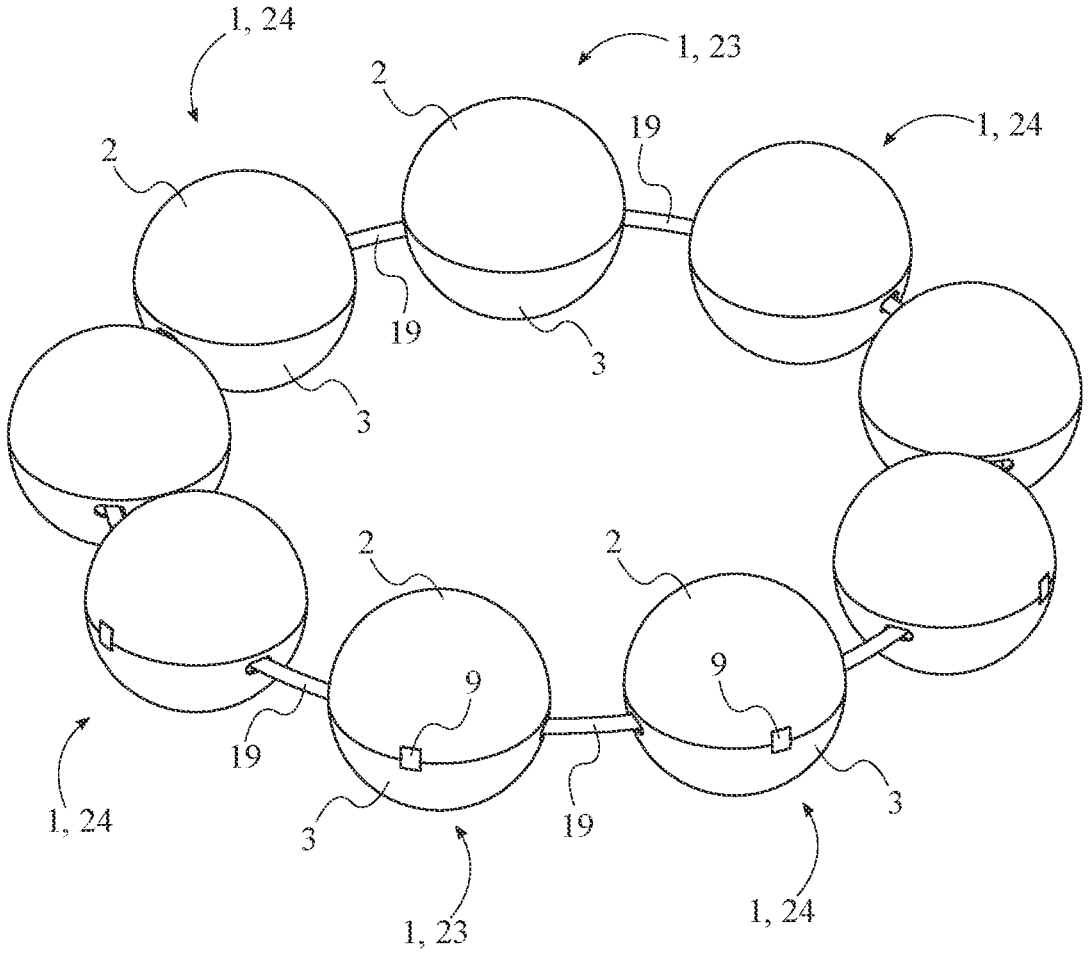
FIG. 1 is a top-front perspective view of the present invention.
Figure 2:
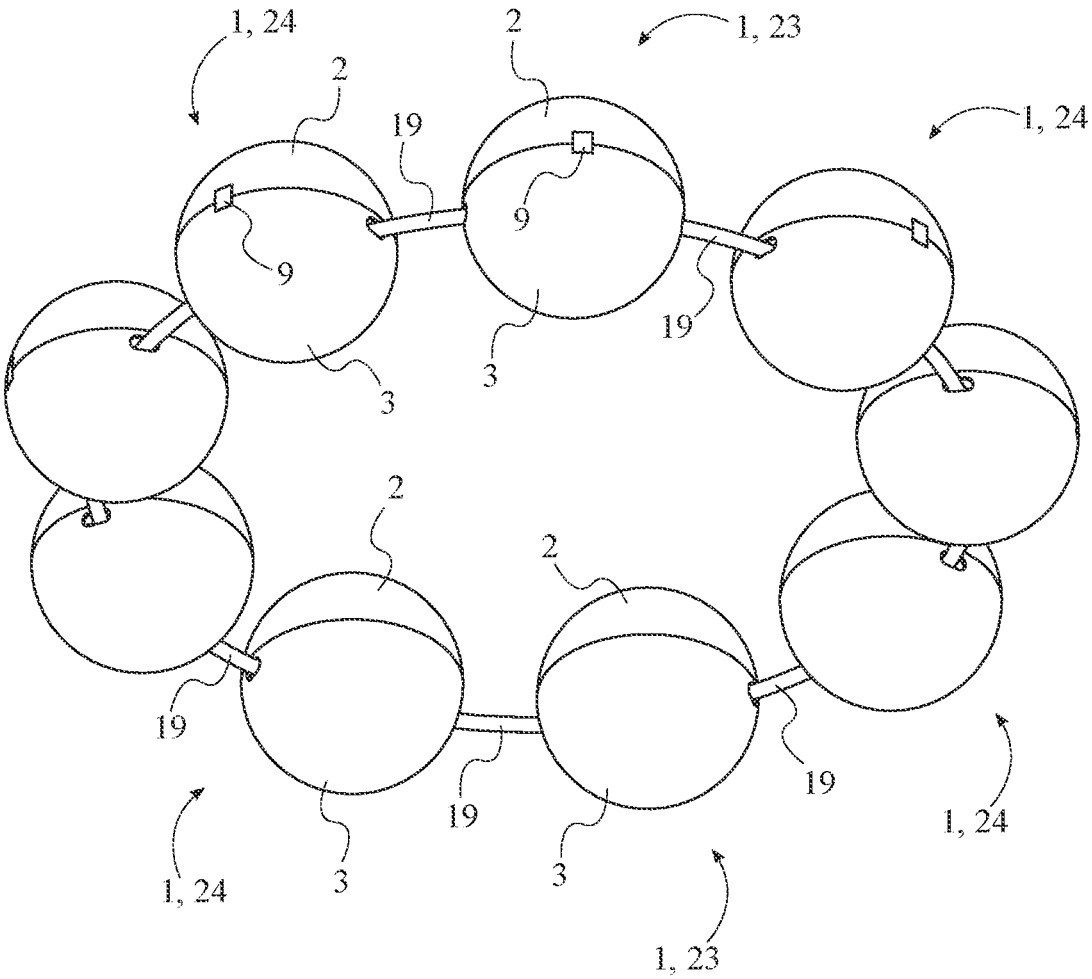
FIG. 2 is a bottom-rear perspective view of the present invention.
Figure 3:
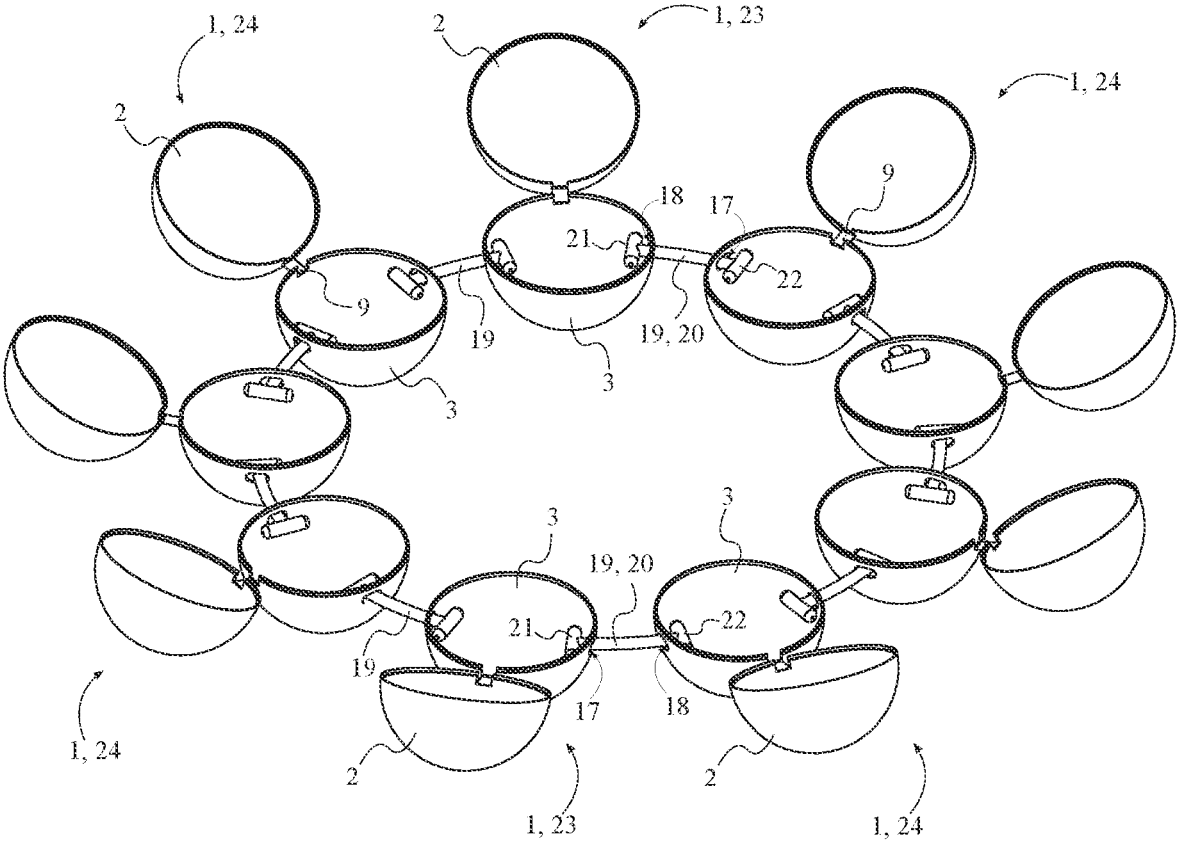
FIG. 3 is a top-front perspective view of the present invention, wherein the plurality of spherical containers is shown opened.
Figure 4:
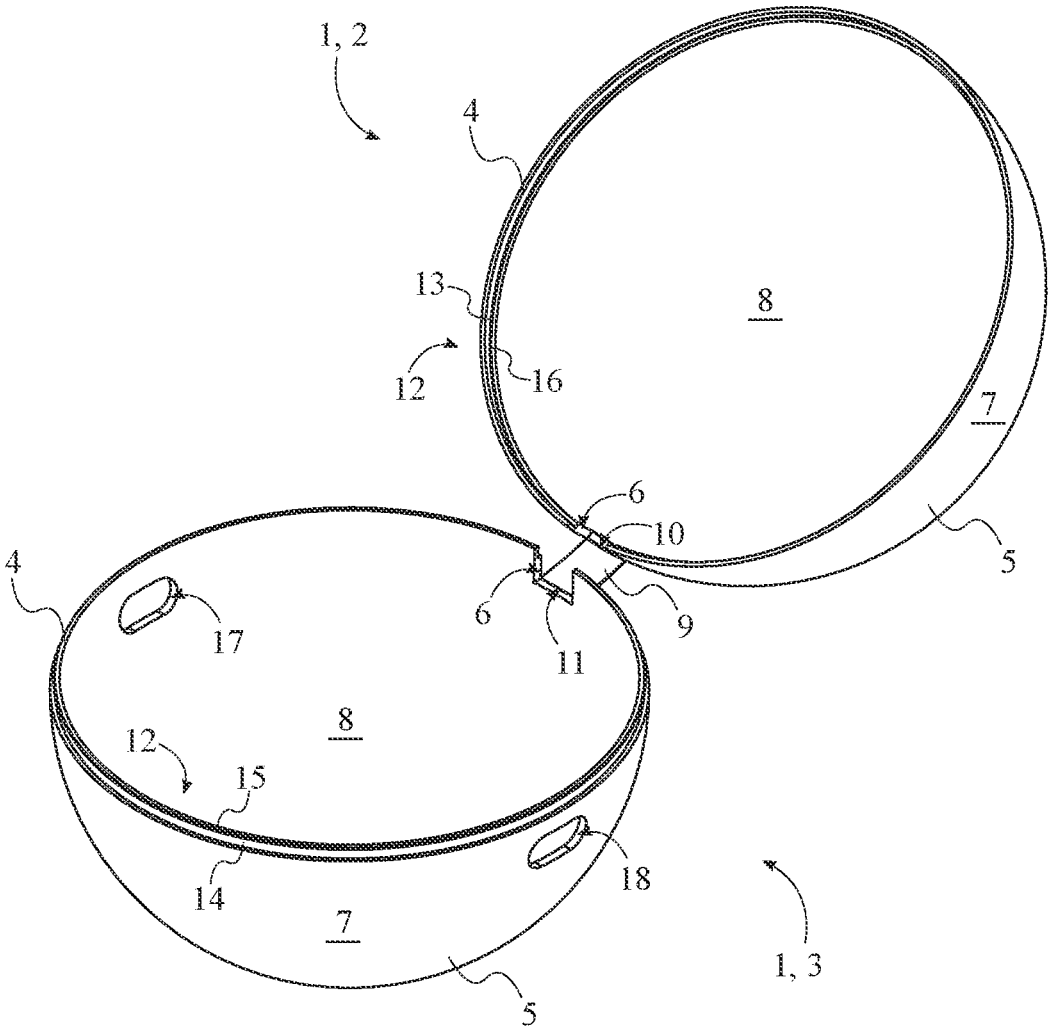
FIG. 4 is a top-front perspective view of a spherical container of the present invention, wherein the spherical container is shown opened.
Figure 5:
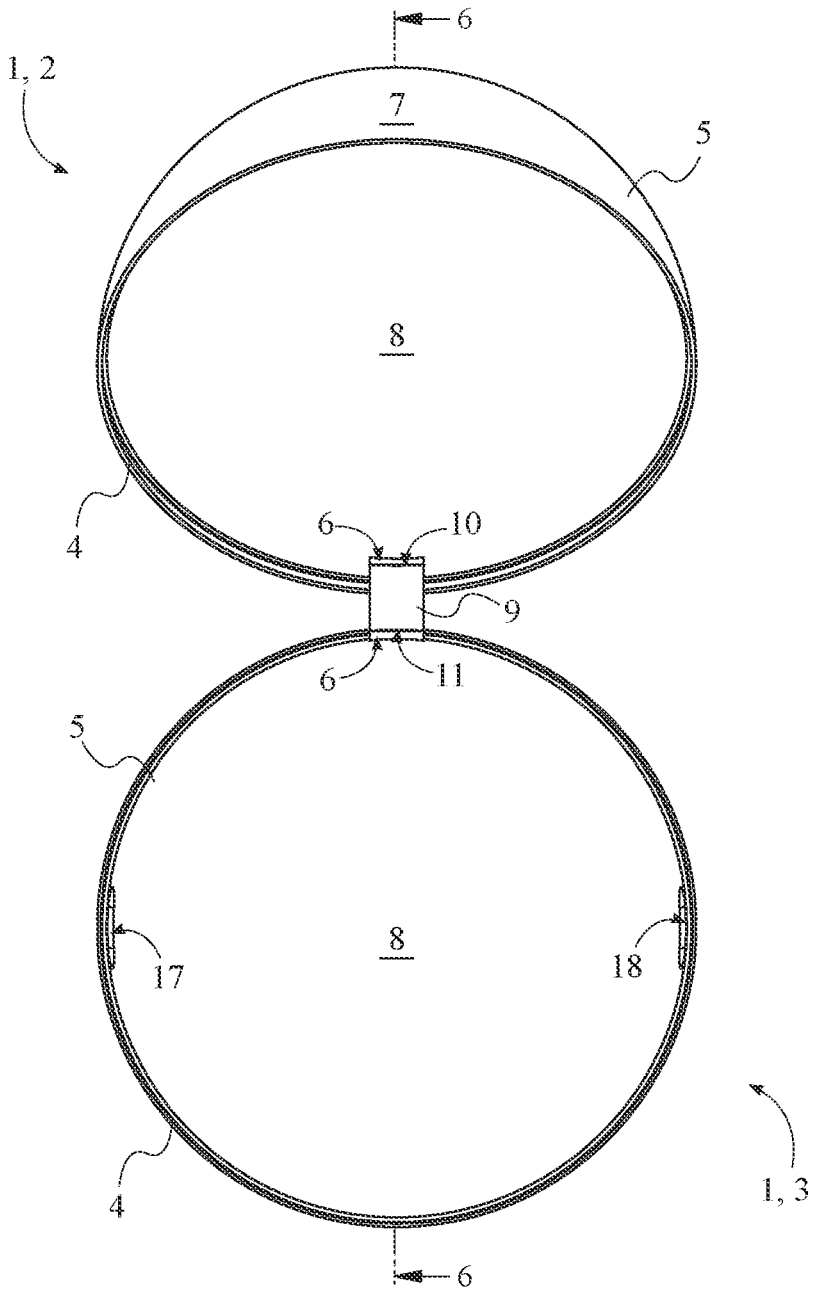
FIG. 5 is a top view of a spherical container of the present invention, wherein the spherical container is shown opened.
Figure 6:
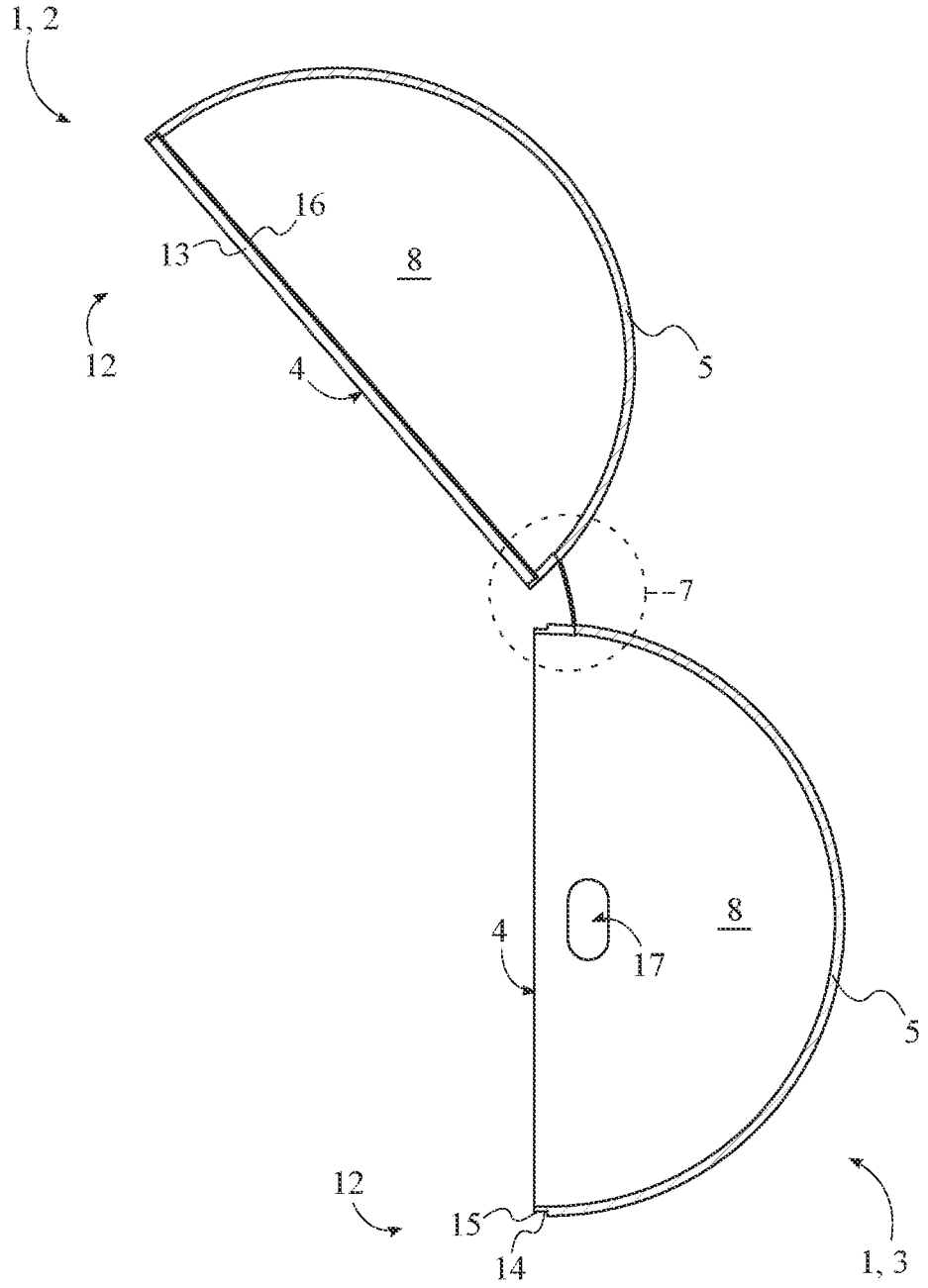
FIG. 6 is a vertical cross-sectional view of the spherical container taken in the direction of line 6-6 in FIG. 5.
Figure 7:
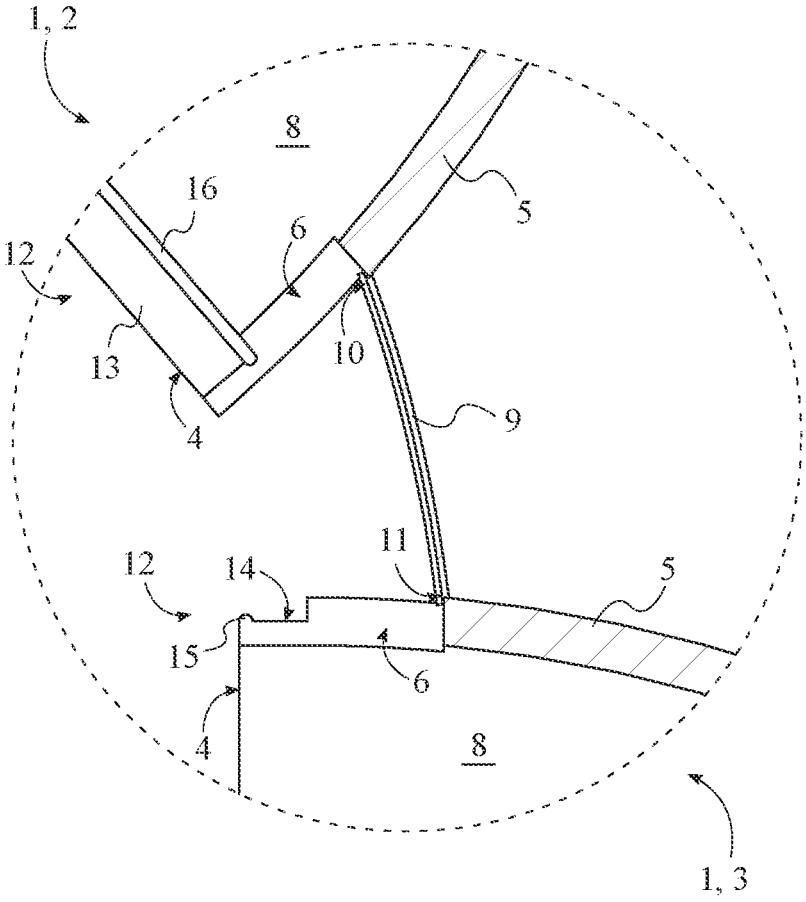
FIG. 7 is a magnified view of a single-piece strap hinge shown in FIG. 6.
Figure 8:
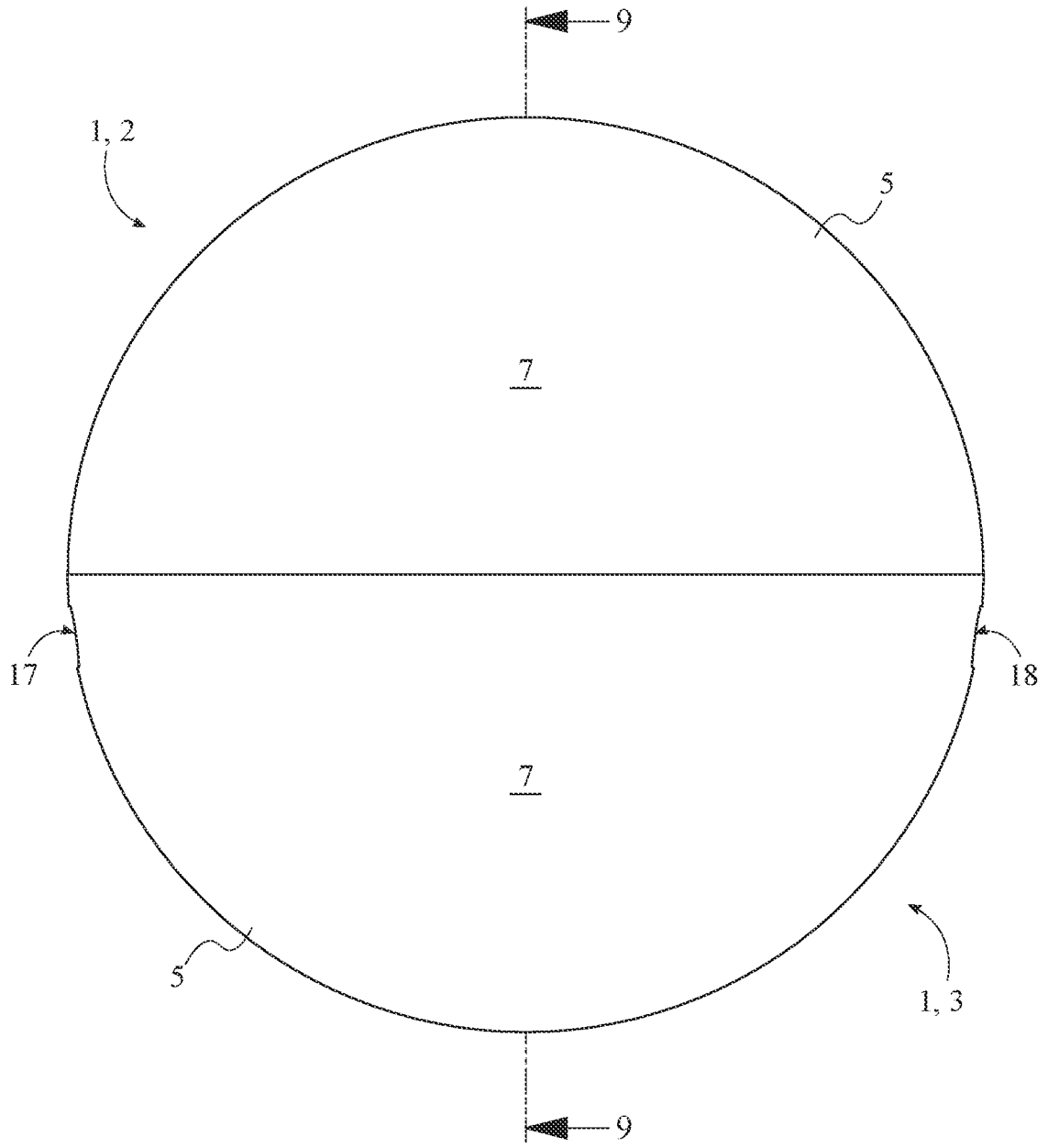
FIG. 8 is a front view of a spherical container of the present invention, wherein the spherical container is shown closed.
Figure 9:
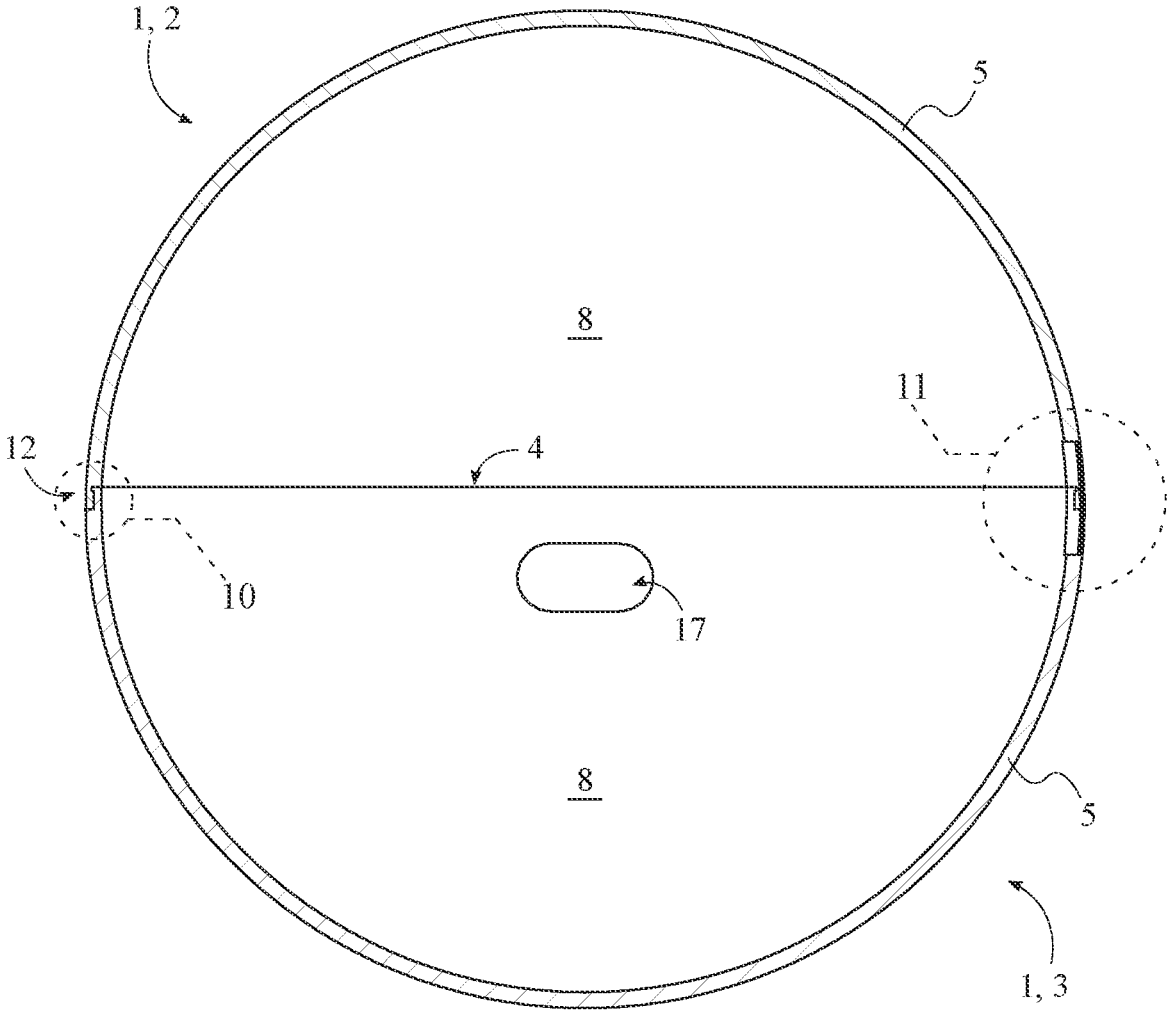
FIG. 9 is a vertical cross-sectional view of the spherical container taken in the direction of line 9-9 in FIG. 8.
Figure 10:
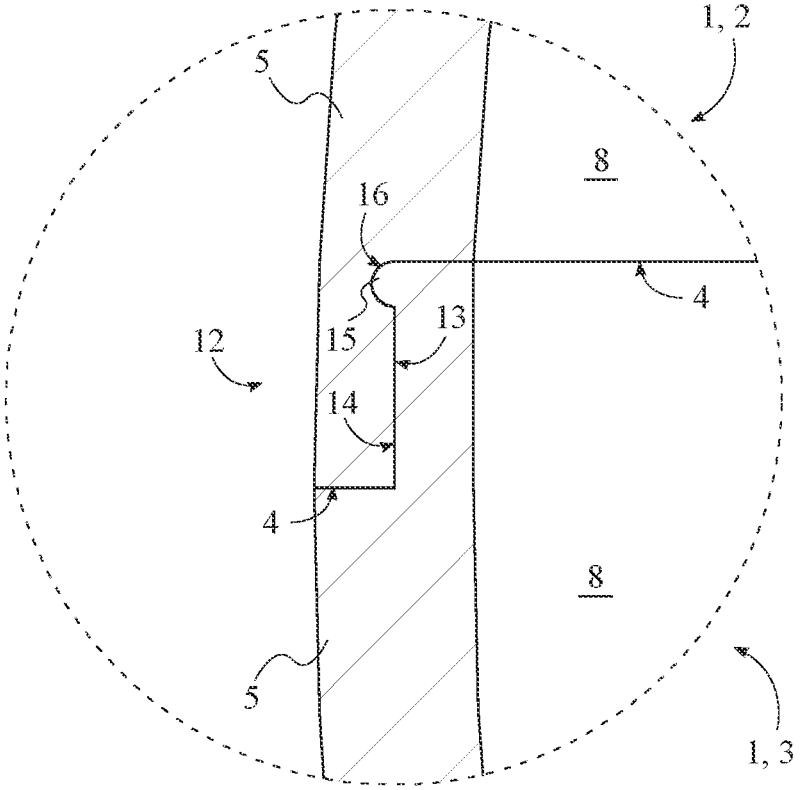
FIG. 10 is a magnified view of a snap-fit connector shown in FIG. 9.
Figure 11:
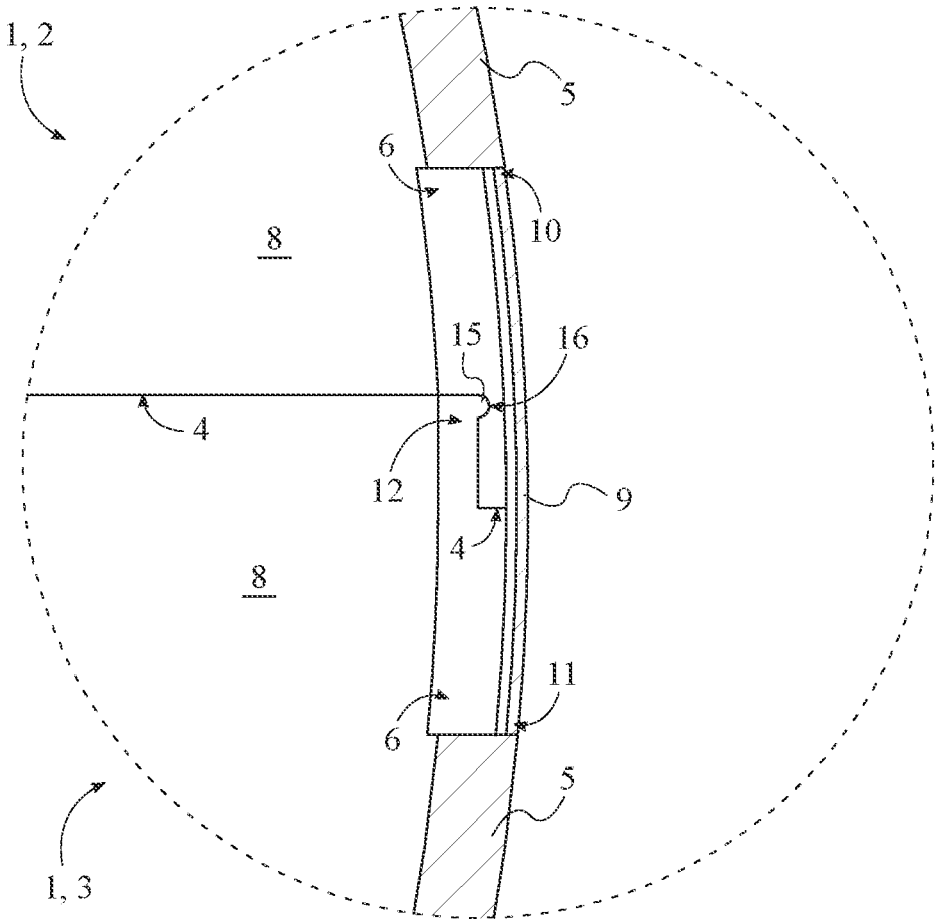
FIG. 11 is a magnified view of a single-piece strap hinge shown in FIG. 9.
Figure 12:
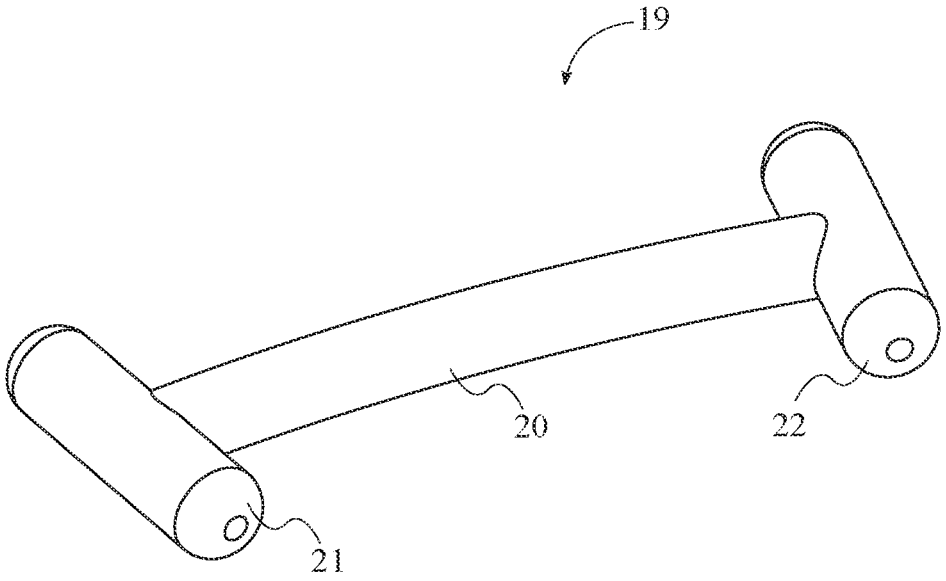
FIG. 12 is a top-front perspective view of a treasury tag of the present invention.

The present invention is a portable small-item storage apparatus that enables the user to carry various small items including, but not limited to, wet wipes, band-aids, etc., in a practical and comfortable manner. As can be seen in FIGS. 1 through 3, the present invention comprises a plurality of spherical containers 1 and a plurality of treasury tags 19. The plurality of spherical containers 1 includes several spherical containers arranged to store different small items. The plurality of spherical containers 1 can be selectively opened to retrieve the items stored within the various spherical containers. The plurality of spherical containers 1 can also be configured to enable the controlled dispensing of the items stored within the various spherical containers. The plurality of treasury tags 19 enables the arrangement of the plurality of spherical containers 1 into a circular pattern so that the present invention can be comfortably worn by the user as a bracelet. The plurality of treasury tags 19 also enables the present invention to expand or contract to comfortably fit on the user's arm.

The general configuration of the aforementioned components enables the user to carry essential items such as, but not limited to, wet wipes, band-aids, vitamins, etc., in a readily available manner. As can be seen in FIGS. 1 through 3, the plurality of spherical containers 1 includes several spherical containers that are preferably hollow with a size large enough to retain a desired number of items. The plurality of spherical containers 1 can be made from different plastic materials that are comfortable to wear on the arm. The plurality of spherical containers 1 can be made from solid materials or flexible materials that are resilient enough to retain the spherical shape. To facilitate the retrieval of the items stored within the plurality of spherical containers 1, the plurality of spherical containers 1 is preferably designed as hollow containers that can be selectively opened to retrieve the items stored within. Accordingly, each of the plurality spherical containers comprises a first hemispherical piece 2 and a second hemispherical piece 3. The first hemispherical piece 2 and the second hemispherical piece 3 correspond to the halves of each spherical container of matching size. Further, the first hemispherical piece 2 and the second hemispherical piece 3 each comprises a hemispherical base rim 4. The hemispherical base rim 4 is designed to facilitate the removable connection between the first hemispherical piece 2 and the second hemispherical piece 3. Further, the hemispherical base rim 4 of the first hemispherical piece 2 is oriented towards the hemispherical base rim 4 of the second hemispherical piece 3. In addition, the first hemispherical piece 2 is hingedly connected to the second hemispherical piece 3. This way, the desired spherical containers can be opened by moving the first hemispherical piece 2 away from the second hemispherical piece 3. Alternatively, the desired spherical container can be closed by positioning the hemispherical base rim 4 of the first hemispherical piece 2 against the hemispherical base rim 4 of the second hemispherical piece 3 which seals the corresponding spherical container.

As can be seen in FIGS. 1 through 3, the plurality of spherical containers 1 is arranged in a circular pattern so that the present invention can be worn as a bracelet by the user. The circular pattern of the plurality of spherical containers 1 enables all the items in the plurality of spherical containers 1 to be kept together so that the user can quickly retrieve any desired item from the corresponding spherical container. In addition, the circular pattern is maintained by the plurality of treasury tags 19 that keep the plurality of spherical containers 1 connected to each other. To form the bracelet-like structure of the present invention, the second hemispherical piece 3 of an arbitrary spherical container 23 is tethered to the second hemispherical piece 3 of an adjacent spherical container 24 by a corresponding treasury tag from the plurality of treasury tags 19. Further, the arbitrary spherical container 23 is any container from the plurality of spherical containers 1, and the adjacent spherical container 24 is from the plurality of spherical containers 1. In other words, every second hemispherical piece 3 of an arbitrary spherical container 23 is connected to the second hemispherical piece 3 of the adjacent spherical container 24 by a treasury tag. Further, since each treasury tag is an elastic structure, the arbitrary spherical container 23 can move away from the adjacent spherical container 24 when a force is applied that separates the two spherical containers away from each other. After the force is removed, the arbitrary spherical container 23 moves closer to the adjacent spherical container 24 due to the compressive force of the treasury tag. In other embodiments, some of the plurality of spherical containers 1 can be provided as a single-body structure that cannot be opened but includes different means to dispense the retained items.

As can be seen in FIGS. 4 through 7, to facilitate the opening and closing of the plurality of spherical containers 1, each of the plurality of spherical containers 1 may further comprise a single-piece strap hinge 9. The single-piece strap hinge 9 enables the corresponding spherical container to be opened and closed without the corresponding first hemispherical piece 2 separating from the second hemispherical piece 3. In addition, the single-piece strap hinge 9 is designed to match the shape and design of the corresponding spherical container so that the single-piece strap hinge 9 disappears when the corresponding spherical container is closed. To do so, the first hemispherical piece 2 and the second hemispherical piece 3 may each further comprise a hemispherical wall 5 and a hinge-receiving cutout 6. The hemispherical wall 5 corresponds to the lateral wall of the corresponding hemispherical piece. The hinge-receiving cutout 6 enables the single-piece strap hinge 9 to match the shape and design of the corresponding spherical container when the corresponding spherical container is closed. Further, the single-piece strap hinge 9 comprises a first strap end 10 and a second strap end 11 corresponding to the terminal ends of the single-piece strap hinge 9. To connect the first hemispherical piece 2 to the second hemispherical piece 3 using the single-piece strap hinge 9, the hinge-receiving cutout 6 laterally traverses through the hemispherical wall 5. In addition, the hinge-receiving cutout 6 traverses into the hemispherical wall 5 from the hemispherical base rim 4. This leaves an empty space near the hemispherical base rim 4 where the single-piece strap hinge 9 can fit into. Furthermore, the hinge-receiving cutout 6 of the first hemispherical piece 2 is positioned adjacent to the hinge-receiving cutout 6 of the second hemispherical piece 3 so that the single-piece strap hinge 9 can fit in between the hinge-receiving cutout 6 of the first hemispherical piece 2 and the hinge-receiving cutout 6 of the second hemispherical piece 3. The first strap end 10 is connected into the hinge-receiving cutout 6 of the first hemispherical piece 2 to connect the single-piece strap hinge 9 to the first hemispherical piece 2. Similarly, the second strap end 11 is connected into the hinge-receiving cutout 6 of the second hemispherical piece 3 to connect the single-piece strap hinge 9 to the second hemispherical piece 3. This way, when the corresponding spherical container is closed, the single-piece strap hinge 9 perfectly fits in the hinge-receiving cutout 6 of both hemispherical pieces to complete the spherical shape of the corresponding spherical container.

As can be seen in FIGS. 1 through 3, as previously discussed, the plurality of spherical containers 1 is arranged in a circular pattern so that the present invention can be worn as a bracelet by the user. However, to prevent the different spherical containers from blocking each other when opened, the single-piece strap hinge 9 for each of the plurality of spherical containers 1 is peripherally positioned about the circular pattern. In other words, the single-piece strap hinge 9 is positioned on the outer perimeter of the overall circular structure of the present invention which makes each spherical container to open outwards instead of inwards. This prevents each spherical container from obstructing the opening of adjacent spherical containers 24. In other embodiments, different fastening mechanisms can be utilized. For example, the first hemispherical piece 2 can be screwed onto the second hemispherical piece 3.

As can be seen in FIGS. 4 through 11, to keep the hemispherical pieces fastened to each other so that the corresponding spherical container remains closed, each of the plurality of spherical containers 1 may further comprise a snap-fit connector 12. The snap-fit connector 12 enables the secure fastening of the first hemispherical piece 2 to the second hemispherical piece 3 to keep the corresponding spherical container closed while also enabling the user to easily release the connection to open the desired spherical container. Further, the first hemispherical piece 2 and the second hemispherical piece 3 may each further comprise a convex surface 7 and a concave surface 8. The convex surface 7 corresponds to the exterior surface of the corresponding hemispherical piece, while the concave surface 8 corresponds to the interior surface of the corresponding hemispherical piece. Further, the snap-fit connector 12 may comprise an inner lip recess 13 and an outer lip recess 14. The inner lip recess 13 and the outer lip recess 14 are arranged to overlap each other so that the hemispherical base rim 4 of the first hemispherical piece 2 perfectly fits over the hemispherical base rim 4 of the second hemispherical piece 3. Accordingly, the outer lip recess 14 is integrated into the hemispherical base rim 4 of the second hemispherical piece 3 from the convex surface 7 of the second hemispherical piece 3. Similarly, the inner lip recess 13 is integrated into the hemispherical base rim 4 of the first hemispherical piece 2 from the concave surface 8 of the first hemispherical piece 2. Furthermore, the outer lip recess 14 and the inner lip recess 13 are shaped to engage with each other. This way, when the hemispherical base rim 4 of the first hemispherical piece 2 is positioned against the hemispherical base rim 4 of the second hemispherical piece 3, the inner lip recess 13 overlaps the outer lip recess 14 so that both recesses engage with each other.

As can be seen in FIGS. 4 through 11, to further secure the first hemispherical piece 2 to the second hemispherical piece 3, the snap-fit connector 12 may further comprise an annular protrusion 15 and an annular groove 16. The annular protrusion 15 and the annular groove 16 are designed to engage with each other to further strengthen the connection between the outer lip recess 14 and the inner lip recess 13. Accordingly, the annular protrusion 15 is integrated into the hemispherical base rim 4 of the second hemispherical piece 3, adjacent to the outer lip recess 14, to secure the annular protrusion 15 to the hemispherical base rim 4 of the second hemispherical piece 3. Further, the annular groove 16 is integrated into the hemispherical base rim 4 of the first hemispherical piece 2, adjacent to the inner lip recess 13, to receive the annular protrusion 15 on the hemispherical base rim 4 of the second hemispherical piece 3. Further, the annular protrusion 15 and the annular groove 16 are shaped to engage with each other. For example, the annular protrusion 15 can be a hemispherical annular protrusion 15, and the annular groove 16 is a hemispherical annular groove 16. Then, to fasten the first hemispherical piece 2 to the second hemispherical piece 3, the inner lip recess 13 is positioned over the outer lip recess 14 so that the annular protrusion 15 engages with the annular groove 16. In other embodiments, the snap-fit connector 12 can be modified to accommodate non-spherical containers.

As previously discussed, the plurality of treasury tags 19 is used to connect the plurality of spherical containers 1 together. As can be seen in FIGS. 1 through 4 and 12, to accommodate the plurality of treasury tags 19, each of the plurality spherical containers may further comprise a first tag hole 17 and a second tag hole 18. The first tag hole 17 and the second tag hole 18 enable the treasury tag to be fastened to the corresponding spherical container. Further, each of the plurality of treasury tags 19 may comprise an elastic string segment 20, a first cross-piece 21, and a second cross-piece 22. The elastic string segment 20 corresponds to the string body of the corresponding treasury tag. The first cross-piece 21 and the second cross-piece 22 correspond to the terminal portions of the corresponding treasury tag. To secure the arbitrary spherical container 23 to the adjacent spherical container 24 using a corresponding treasury tag, the first tag hole 17 and the second tag hole 18 traverses into the second hemispherical piece 3. In addition, the first tag hole 17 and the second tag hole 18 are positioned opposite to each other about the second hemispherical piece 3. This way, the two adjacent spherical containers 24 of the arbitrary spherical container 23 are positioned opposite to each other across the arbitrary spherical container 23. Further, the first cross-piece 21 and the second cross-piece 22 are tethered to each other by the elastic string segment 20. In other words, the elastic string segment 20 is positioned in between the first cross-piece 21 and the second cross-piece 22. Furthermore, the first cross-piece 21 of the corresponding treasury tag is positioned within the arbitrary spherical container 23. On the other hand, the second cross-piece 22 of the corresponding treasury tag is positioned within the adjacent spherical container 24. In addition, the elastic string segment 20 is positioned through the second tag hole 18 of the arbitrary spherical container 23 and the first tag hole 17 of the adjacent spherical container 24. This way, the plurality of spherical containers 1 is fastened to each other by the plurality of treasury tags 19 in such a way that the overall circular structure can expand to accommodate the arm of the user and contract to the original shape/size once the present invention has been removed from the arm of the user. In other embodiments, different elastic fasteners can be utilized to connect the plurality of spherical containers 1 to each other.

Figure 13:
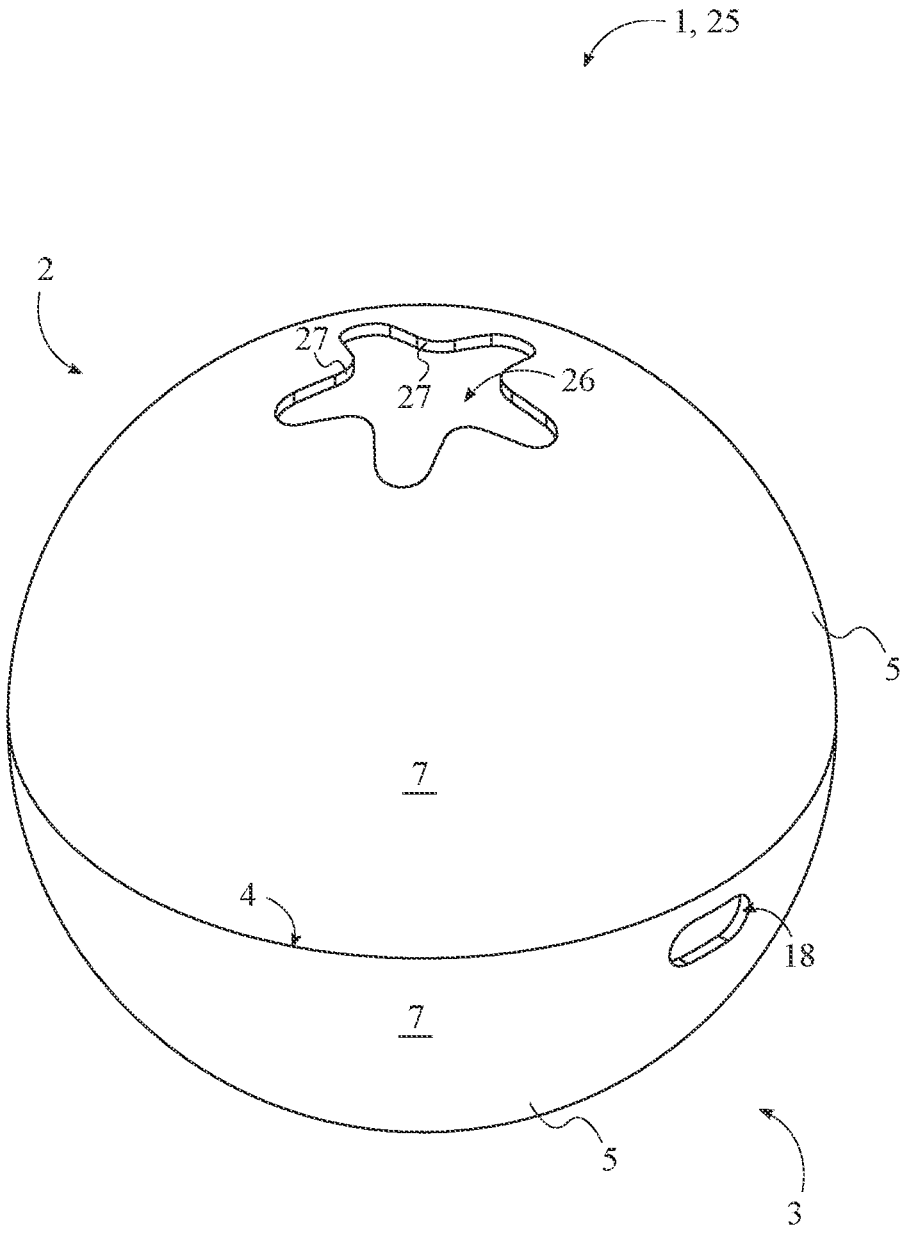
FIG. 13 is a top-front perspective view of a dispensing spherical container of the plurality of spherical containers of the present invention.

As previously discussed, some of the plurality of spherical containers 1 can be arranged to enable the dispensing of the retained items in a controlled manner. For example, one or more spherical containers can be arranged to dispense wet wipes. As can be seen in FIG. 13, the plurality of spherical containers 1 may comprise at least one dispensing spherical container 25. To facilitate the controlled dispensing of the retained items, the at least one dispensing spherical container 25 may comprise at least one dispensing hole 26. The at least one dispensing spherical container 25 can be designed as a single-body spherical container so that the retained items can only be dispensed through the at least one dispensing hole 26. The at least one dispensing hole 26 is designed to enable the controlled dispensing of the items retained within the at least one dispensing spherical container 25. Further, the at least one dispensing hole 26 traverses through the first hemispherical piece 2 of the dispensing spherical container to enable the user to dispense a desired number of items retained within the at least one dispensing spherical container 25.

As can be seen in FIG. 13, to enable the controlled dispensing of the retained items, the at least one dispensing spherical container 25 may further comprise a plurality of gripping fins 27. The plurality of gripping fins 27 includes several gripping fins designed to grab onto the item as the item is being dispensed so that only a limited number of items are dispensed at a time. For example, the plurality of gripping fins 27 controls the number of wet wipes being dispensed so that the user does not accidentally retrieve all the wet wipes retained in the at least one dispensing spherical container 25. To do so, the plurality of gripping fins 27 is peripherally positioned within the at least one dispensing hole 26. This way, the plurality of gripping fins 27 does not completely block the dispensing of the retained items. Further, each of the plurality of gripping fins 27 is terminally connected to first hemispherical piece 2 of the at least one dispensing spherical container 25. This way, the free ends of the plurality of gripping fins 27 can grab onto the items being dispensed to control the number of items being dispensed. In other embodiments, different dispensing mechanisms can be utilized to control the number of items being dispensed at a time.

Figure 14:
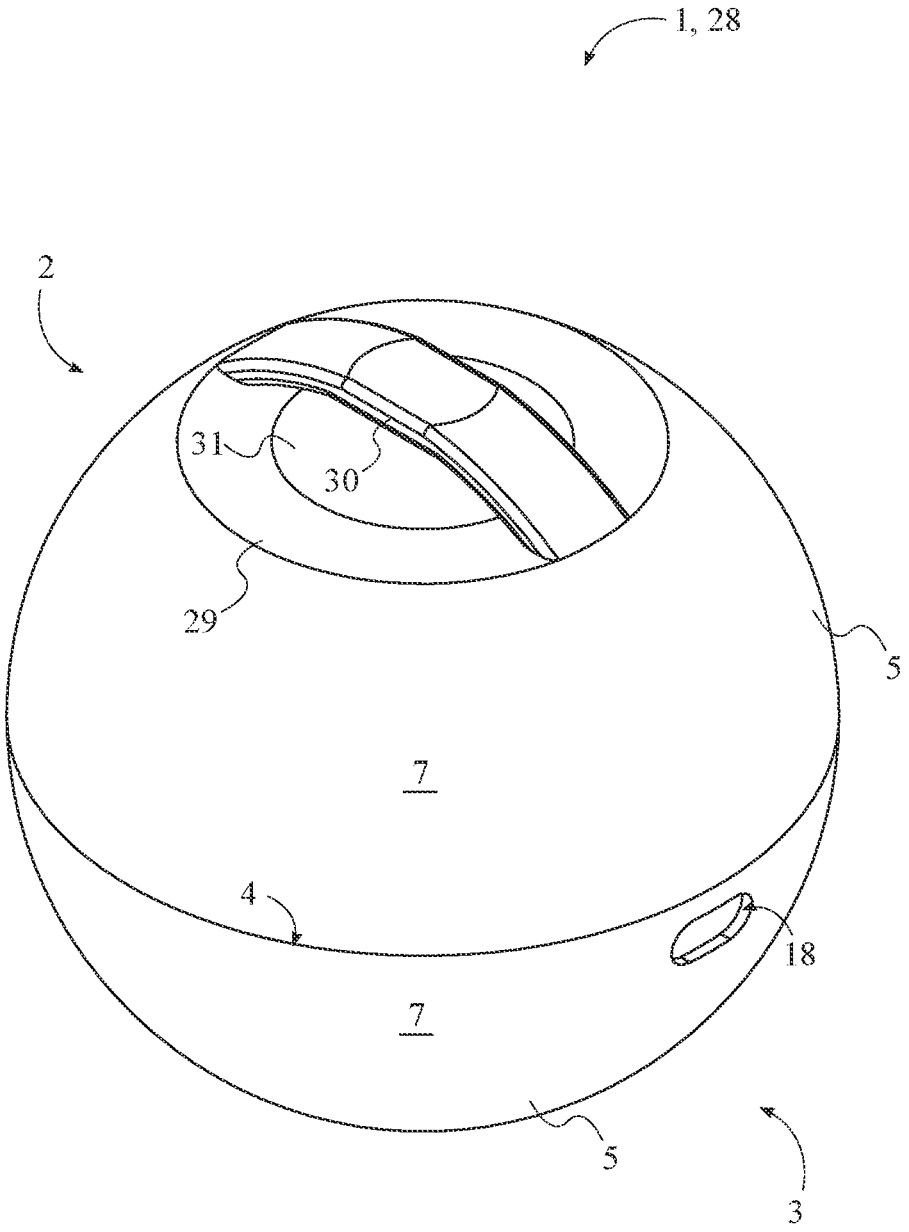
FIG. 14 is a top-front perspective view of an anchored spherical container of the plurality of spherical containers of the present invention.

Due to the spherical shape of the plurality of spherical containers 1, the present invention may further provide means to enable the user to easily open the desired spherical containers. As can be seen in FIG. 14, to facilitate the opening of the desired spherical containers, the plurality of spherical containers 1 may comprise at least one anchored spherical container 28. The at least one anchored spherical container 28 is designed to be easily opened by the user. To do so, the at least one anchored spherical container 28 may comprise an eyelet recession 29 and an anchoring eyelet 30. The eyelet recession 29 is designed to accommodate the anchoring eyelet 30 so that the anchoring eyelet 30 can be used as a handle to facilitate the opening of the at least one anchored spherical container 28. Accordingly, the eyelet recession 29 is integrated into the first hemispherical piece 2 of the at least one anchored spherical container 28. Further, the anchoring eyelet 30 is connected onto the eyelet recession 29 to secure the anchoring eyelet 30 to the first hemispherical piece 2. This way, as the user pulls on the anchoring eyelet 30, the first hemispherical piece 2 is released from the second hemispherical piece 3. The anchoring eyelet 30 can also be utilized to receive a key ring, loop, etc., to hang the present invention from an external object.

As can be seen in FIG. 14, to further accommodate the fingers of the user, the at least one anchored spherical container 28 of the plurality spherical containers may further comprise a clearance recess 31. The clearance recess 31 is designed to accommodate the fingertips of the user. To do so, the clearance recess 31 is centered on the eyelet recession 29, adjacent to the anchoring eyelet 30, so that the position of the clearance recess 31 matches the position of the anchoring eyelet 30. Further, the clearance recess 31 traverses into the first hemispherical piece 2 of the at least one anchored spherical container 28 from the eyelet recession 29. This way, as the fingertips of the user grab onto the anchoring eyelet 30, the user does not feel discomfort. In other embodiments, the at least one anchored spherical container 28 can be modified to accommodate other mechanisms that facilitate the opening of the at least one anchored spherical container 28. In other embodiments, one or more spherical containers of the plurality of spherical containers 1 can be modified to retain special items or to dispense the retained items in a controlled manner.

In some embodiments, the present invention may further include an attachment mechanism that enables the present invention to be hanged from an external object, such as a handbag. The attachment mechanism enables the user to removably attach the present invention to an external object so that the user does not have to carry or wear the present invention. To do so, the attachment mechanism may comprise a snap hook and a key ring. The key ring enables the snap hook to be fastened to an external object. The snap hook enables the quick attachment of the present invention to the external object. Further, the snap hook can be terminally connected to the key ring. The snap hook can then be fastened to a treasury tag of the plurality of treasure tags or to the anchoring eyelet 30 of the at least one anchored spherical container 28. The attachment mechanism may further comprise a decorative element such as, but not limited to, a tassel, that is terminally connected to the key ring. The decorative element not only improves the overall ornamental look of the attachment mechanism but also enables the location and identification of the attachment mechanism by the user. In other embodiments, the present invention may include different attachment mechanisms that enable the removable attachment of the present invention to specific external objects.

Although the invention has been explained in relation to its preferred embodiment, it is to be understood that many other possible modifications and variations can be made without departing from the spirit and scope of the invention.

What is claimed is:

1. A portable small-item storage apparatus comprising:

a plurality of spherical containers;

a plurality of treasury tags;

each of the plurality spherical containers comprising a first hemispherical piece, a second hemispherical piece, and a single-piece strap hinge;

the first hemispherical piece and the second hemispherical piece each comprising a hemispherical base rim, a hemispherical wall, and a hinge-receiving cutout;

the single-piece strap hinge comprising a first strap end and a second strap end;

the hemispherical base rim of the first hemispherical piece being oriented towards the hemispherical base rim of the second hemispherical piece;

the first hemispherical piece being hingedly connected to the second hemispherical piece;

the plurality of spherical containers being arranged in a circular pattern;

the second hemispherical piece of an arbitrary spherical container being tethered to the second hemispherical piece of an adjacent spherical container by a corresponding treasury tag from the plurality of treasury tags, wherein the arbitrary spherical container is any container from the plurality of spherical containers, and wherein the adjacent spherical container is from the plurality of spherical containers;

the hinge-receiving cutout laterally traversing through the hemispherical wall;

the hinge-receiving cutout traversing into the hemispherical wall from the hemispherical base rim;

the hinge-receiving cutout of the first hemispherical piece being positioned adjacent to the hinge-receiving cutout of the second hemispherical piece;

the first strap end being connected into the hinge-receiving cutout of the first hemispherical piece; and the second strap end being connected into the hinge-receiving cutout of the second hemispherical piece.

2. The portable small-item storage apparatus as claimed in claim claim 1 comprising:

the single-piece strap hinge for each of the plurality of spherical containers being peripherally positioned about the circular pattern.

3. The portable small-item storage apparatus as claimed in claim 1 comprising:

each of the plurality of spherical containers further comprising a snap-fit connector;

the first hemispherical piece and the second hemispherical piece each further comprising a convex surface and a concave surface;

the snap-fit connector comprising an inner lip recess and an outer lip recess;

the outer lip recess being integrated into the hemispherical base rim of the second hemispherical piece from the convex surface of the second hemispherical piece;

the inner lip recess being integrated into the hemispherical base rim of the first hemispherical piece from the concave surface of the first hemispherical piece; and the outer lip recess and the inner lip recess being shaped to engage with each other.

4. The portable small-item storage apparatus as claimed in claim 3 comprising:

the snap-fit connector further comprising an annular protrusion and an annular groove;

the annular protrusion being integrated into the hemispherical base rim of the second hemispherical piece, adjacent to the outer lip recess;

the annular groove being integrated into the hemispherical base rim of the first hemispherical piece, adjacent to the inner lip recess; and the annular protrusion and the annular groove being shaped to engage with each other.

5. The portable small-item storage apparatus as claimed in claim 1 comprising:

each of the plurality spherical containers further comprising a first tag hole and a second tag hole;

each of the plurality of treasury tags comprising an elastic string segment, a first cross-piece, and a second cross-piece;

the first tag hole and the second tag hole traversing into the second hemispherical piece;

the first tag hole and the second tag hole being positioned opposite to each other about the second hemispherical piece;

the first cross-piece and the second cross-piece being tethered to each other by the elastic string segment;

the first cross-piece of the corresponding treasury tag being positioned within the arbitrary spherical container;

the second cross-piece of the corresponding treasury tag being positioned within the adjacent spherical container; and the elastic string segment being positioned through the second tag hole of the arbitrary spherical container and the first tag hole of the adjacent spherical container.

6. The portable small-item storage apparatus as claimed in claim 1 comprising:

the plurality of spherical containers comprising at least one dispensing spherical container;

the at least one dispensing spherical container comprising at least one dispensing hole; and the at least one dispensing hole traversing through the first hemispherical piece of the dispensing spherical container.

7. The portable small-item storage apparatus as claimed in claim 6 comprising:

the at least one dispensing spherical container further comprising a plurality of gripping fins;

the plurality of gripping fins being peripherally positioned within the at least one dispensing hole; and each of the plurality of gripping fins being terminally connected to first hemispherical piece of the at least one dispensing spherical container.

8. The portable small-item storage apparatus as claimed in claim 1 comprising:

the plurality of spherical containers comprising at least one anchored spherical container;

the at least one anchored spherical container comprising an eyelet recession and an anchoring eyelet;

the eyelet recession being integrated into the first hemispherical piece of the at least one anchored spherical container; and the anchoring eyelet being connected onto the eyelet recession.

9. The portable small-item storage apparatus as claimed in claim 8 comprising:

the at least one anchored spherical container of the plurality spherical containers further comprising a clearance recess;

the clearance recess being centered on the eyelet recession, adjacent to the anchoring eyelet; and the clearance recess traversing into the first hemispherical piece of the at least one anchored spherical container from the eyelet recession.

10. A portable small-item storage apparatus comprising:

a plurality of spherical containers;

a plurality of treasury tags;

each of the plurality spherical containers comprising a first hemispherical piece and a second hemispherical piece, a first tag hole, and a second tag hole;

each of the plurality of treasury tags comprising an elastic string segment, a first cross-piece, and a second cross-piece;

the first hemispherical piece and the second hemispherical piece each comprising a hemispherical base rim;

the hemispherical base rim of the first hemispherical piece being oriented towards the hemispherical base rim of the second hemispherical piece;

the first hemispherical piece being hingedly connected to the second hemispherical piece;

the plurality of spherical containers being arranged in a circular pattern;

the second hemispherical piece of an arbitrary spherical container being tethered to the second hemispherical piece of an adjacent spherical container by a corresponding treasury tag from the plurality of treasury tags, wherein the arbitrary spherical container is any container from the plurality of spherical containers, and wherein the adjacent spherical container is from the plurality of spherical containers;

the first tag hole and the second tag hole traversing into the second hemispherical piece;

the first tag hole and the second tag hole being positioned opposite to each other about the second hemispherical piece;

the first cross-piece and the second cross-piece being tethered to each other by the elastic string segment;

the first cross-piece of the corresponding treasury tag being positioned within the arbitrary spherical container;

the second cross-piece of the corresponding treasury tag being positioned within the adjacent spherical container; and the elastic string segment being positioned through the second tag hole of the arbitrary spherical container and the first tag hole of the adjacent spherical container.

11. The portable small-item storage apparatus as claimed in claim 10 comprising:

each of the plurality of spherical containers further comprising a single-piece strap hinge;

the first hemispherical piece and the second hemispherical piece each further comprising a hemispherical wall and a hinge-receiving cutout;

the single-piece strap hinge comprising a first strap end and a second strap end;

the hinge-receiving cutout laterally traversing through the hemispherical wall;

the hinge-receiving cutout traversing into the hemispherical wall from the hemispherical base rim;

the hinge-receiving cutout of the first hemispherical piece being positioned adjacent to the hinge-receiving cutout of the second hemispherical piece;

the first strap end being connected into the hinge-receiving cutout of the first hemispherical piece; and the second strap end being connected into the hinge-receiving cutout of the second hemispherical piece.

12. The portable small-item storage apparatus as claimed in claim 11 comprising:

the single-piece strap hinge for each of the plurality of spherical containers being peripherally positioned about the circular pattern.

13. The portable small-item storage apparatus as claimed in claim 10 comprising:

each of the plurality of spherical containers further comprising a snap-fit connector;

the first hemispherical piece and the second hemispherical piece each further comprising a convex surface and a concave surface;

the snap-fit connector comprising an inner lip recess and an outer lip recess;

the outer lip recess being integrated into the hemispherical base rim of the second hemispherical piece from the convex surface of the second hemispherical piece;

the inner lip recess being integrated into the hemispherical base rim of the first hemispherical piece from the concave surface of the first hemispherical piece; and the outer lip recess and the inner lip recess being shaped to engage with each other.

14. The portable small-item storage apparatus as claimed in claim 13 comprising:

the snap-fit connector further comprising an annular protrusion and an annular groove;

the annular protrusion being integrated into the hemispherical base rim of the second hemispherical piece, adjacent to the outer lip recess;

the annular groove being integrated into the hemispherical base rim of the first hemispherical piece, adjacent to the inner lip recess; and the annular protrusion and the annular groove being shaped to engage with each other.

15. The portable small-item storage apparatus as claimed in claim 10 comprising:

the plurality of spherical containers comprising at least one dispensing spherical container;

the at least one dispensing spherical container comprising at least one dispensing hole; and the at least one dispensing hole traversing through the first hemispherical piece of the dispensing spherical container.

16. The portable small-item storage apparatus as claimed in claim 15 comprising:

the at least one dispensing spherical container further comprising a plurality of gripping fins;

the plurality of gripping fins being peripherally positioned within the at least one dispensing hole; and each of the plurality of gripping fins being terminally connected to first hemispherical piece of the at least one dispensing spherical container.

17. The portable small-item storage apparatus as claimed in claim 10 comprising:

the plurality of spherical containers comprising at least one anchored spherical container;

the at least one anchored spherical container comprising an eyelet recession and an anchoring eyelet;

the eyelet recession being integrated into the first hemispherical piece of the at least one anchored spherical container; and the anchoring eyelet being connected onto the eyelet recession.

18. The portable small-item storage apparatus as claimed in claim 17 comprising:

the at least one anchored spherical container of the plurality spherical containers further comprising a clearance recess;

the clearance recess being centered on the eyelet recession, adjacent to the anchoring eyelet; and the clearance recess traversing into the first hemispherical piece of the at least one anchored spherical container from the eyelet recession.

* * * * *